United States Patent [19]

Yasuoka

[11] Patent Number: 4,683,158

[45] Date of Patent: Jul. 28, 1987

[54] CARPET HAVING BOTTOM PORTIONS OF PILE COVERED WITH CARBON BLACK CONTAINING RESIN

[75] Inventor: Toshio Yasuoka, Osaka, Japan

[73] Assignee: Teijin Limited, Osada, Japan

[21] Appl. No.: 854,816

[22] Filed: Apr. 23, 1986

Related U.S. Application Data

[63] Continuation of Ser. No. 724,335, Apr. 17, 1985, abandoned.

[30] Foreign Application Priority Data

Apr. 25, 1984 [JP] Japan ..... 59-81905

[51] Int. Cl.[4] ..... B32B 3/02; B32B 33/00

[52] U.S. Cl. ..... 428/95; 428/96; 428/97

[58] Field of Search ..... 428/95, 96, 97

[56] References Cited

U.S. PATENT DOCUMENTS 4,153,749 5/1979 Klein ..... 428/95

*Primary Examiner*—Marion C. McCamish

*Attorney, Agent, or Firm*—Cushman, Darby & Cushman

[57] ABSTRACT

Disclosed is a carpet having a base fabric, pile yarns tufted to the base fabric and a backing layer covering a back surface of the base fabric. The light resistance of the dyed carpet and the anti-deteriorative properties of the pile yarns can be improved by covering portions of the pile yarns which extend into the backing layer with a resinous material containing finely divided carbon black.

6 Claims, 2 Drawing Figures

CARPET HAVING BOTTOM PORTIONS OF PILE COVERED WITH CARBON BLACK CONTAINING RESIN

This is a continuation of application Ser. No. 724,335, filed Apr. 17, 1985, now abandoned.

BACKGROUND OF THE INVENTION (1) Technical Field

This invention relates to a carpet, particularly to a carpet for an automotive vehicle. More particularly, it relates to a carpet suitable for the use in an automotive vehicle under such severe weather conditions that temperatures of the carpet are highly elevated by exposure to rays of the sun.

(2) Background Information

Conventionally, the carpets for automotive vehicles have been developed for the purpose of improving cushion, warm-keeping, sound-absorbing and sound-insulating properties. For example, Japanese Patent Application Laid-open No. 56-79033/1981 proposes a process for producing a sound-insulting carpet, in which a mixture is pressed in a sheet form to adhere to a back surface of the carpet, the mixture comprising an ethylene copolymer and a compound which contains an inorganic filler in a high concentration and a synthetic resin soluble in the ethylene copolymer as a coagulant. Further, Japanese Patent Application Laid-open No. 58-65079/1983 discloses a carpet for an automotive vehicle, which is backed with an asphaltic composition, and further laminated thereon with a non-woven fabric. Furthermore, Japanese Patent Application Laid-open No. 56-67637/1981 shows a carpet provided with a pad for an automotive vehicle, the pad adhering to the carpet through a hot-melt adhesive which is previously applied to the pad.

However, it has recently been found that the carpet is not only faded or discolored, but also the pile yarns comprising synthetic fibers consisting of polymers such as polyesters, polyamides, polyolefines and polyacrylonitrile are extremely reduced in their strength, when the carpet is used under such severe weather conditions that the surface temperature of the carpet is elevated to more than 100° C., for a prolonged period of time. In a very extreme case, the pile yarns cannot maintain their form to be crushed into powder with feet.

There have rarely been found the proposals for improving such light resistance of the carpet for the automotive vehicle. As one of such proposals, Japanese Patent Application Laid-open No. 56-128274/1981 discloses articles interiorly provided in the vehicle, such as car seats, the articles mainly consisting of a conjugated fiber of the sheath-core type, wherein only a sheath component is dyed. The object of the invention above mentioned is, however, to prevent the dye contained in the interiorly equipped articles of the vehicle from fading and discoloration, but is not to prevent the articles themselves, particularly the pile yarns of the carpet, from deterioration.

SUMMARY OF THE INVENTION

It is therefore a primary object of the present invention to provide a carpet for an automotive vehicle, in which not only the dyed portions are prevented from fading and discoloration, but also pile yarns are prevented from deterioration.

In accordance with the present invention, there is provided a carpet having a base fabric, pile yarns tufted to the base fabric and a backing layer covering a back surface of the base fabric, the pile yarns having portion which extend into the backing layer and which are covered with a resinous material containing finely divided carbon black.

DESCRIPTION OF THE PREFERRED EMBODIMENTS

Referring now in detail to the drawings, pile yarns 1 are tufted to a base fabric 2 and a back surface of the base fabric 2 is covered with a backing layer 3 for fixing the pile yarns 1 to the base fabric 2.

The pile yarns 1 comprises fibers conventionally used for the carpet, such as polyamide fibers, polyester fibers, polyolefin fibers and polyacrylonitrile fibers. The fibers may be used in staple or filament form. The pile yarns 1 may be mix-twisted yarns and coherent yarns of the filaments, or blended spun yarns of the staple fibers. Particularly, crimped filament yarns are preferably employed. The crimped filament yarns may be formed by any processing such as texturing, stuffer box crimping, gear crimping, edge crimping, turbulent air flow crimping, air stuffing crimping or the like.

The base fabric 2 is not limited to a particular material and form. There may be used the material and form such as the knitted, woven or non-woven fabric, which are usually employed in the carpet. As the material of the backing layer 3, there can be mentioned polymeric substances such as polyethylene, ethylene-vinyl acetate copolymers, polybutadiene rubber, styrene-butadiene copolymer rubber, ethylene-propylene copolymers, polyacrylic esters, polyamides and polyesters.

Figure 1:
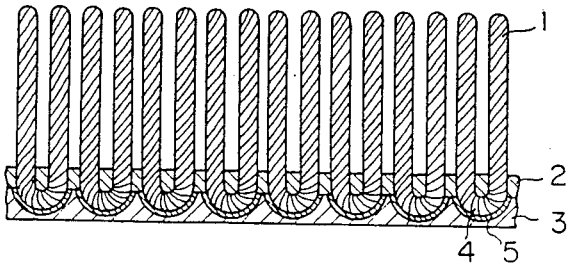
FIG. 1 is an enlarged sectional view showing an embodiment of a carpet according to the present invention.

The pile yarns 1 have portions 4 which extend into the backing layer 3, and the portions 4 are covered with a resinous material 5 containing finely divided carbon black, as shown in FIG. 1.

The resinous material 5 is exemplified by, for example, polyethylene, polypropylene, ethylene-vinyl acetate copolymers, polybutadiene, styrene-butadiene copolymers, ethylene-proplylene copolymers, polyacrylic esters, polyamides and polyesters. The resinous material 5 may be applied to coat the portions 4 of the pile yarns 1, in the state of the dope (highly concentrated solution), the emulsion, the suspension or the melt, by the known methods such as the spraying method, the dipping method and the coating method.

It is preferable that the finely divided carbon black contained in the resinous material 5 has a grain diameter in the range of 10 to 250 mμ. Further, it is preferable that the finely divided carbon black is contained in the resinous material 5 in an amount of 0.005 to 10% by weight, particularly 0.01 to 7% by weight. The resinous material 5 may contain inorganic fillers such as calcium carbonate and aluminium hydroxide.

In the present invention, the portions of the pile yarns which extend into the backing layer are required to be covered with the resinous material containing the finely divided carbon black. All over the back surface of the base fabric, including the portions of the pile yarns which extend into the backing layer, may be covered with the resinous material containing the finely divided carbon black.

Figure 2:
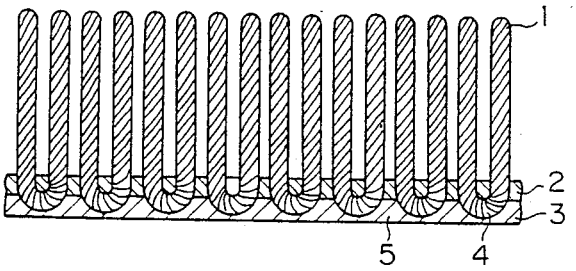
FIG. 2 is an enlarged sectional view showing another embodiment of a carpet according to the present invention.

FIG. 2 shows an embodyment in which the resinous material 5 containing finely divided carbon black is employed as the backing layer 3. This embodyment shown in FIG. 2 is also included in the scope of the present invention.

The present invention will now be described in detail with reference to the following examples that by no means limit the scope of the invention.

The light resistance of the dyed carpet was measured by Sunshine Weatherometer at a black panel temperature of 83° C. A felt of polyethylene terephthalate fibers, which had a thickness of 10 mm, was laid on the back surface of the carpet sample. The pile surface, or the front surface, of the carpet sample was irradiated with the light for periods of 300 hours and 400 hours.

The degree of fading or discoloration was estimated by comparing the pile surface irradiated with the light with that not irradiated, and by grading the difference therebetween, compared to the standard grey scale, as defined in Japanese Industrial Standard B-7753-1977. Grade 1 shows that the pile surface was extremely faded or discolored, and Grade 5 shows that no or little fading or discoloration was observed.

On the other hand, the degree of deterioration of the pile yarns was estimated by the strength retaining ratio which was shown by the following formula:

$$\text{Strength retaining ratio} = (S/S_0) \times 100(\%)$$

wherein $S_0$ is the strength of the pile yarns before irradiated with the light and S is the strength of the pile yarns after irradiated with the light for a period of 300 or 400 hours, $S_0$ and S being measured by Instron Tensile Tester.

EXAMPLES 1 TO 3 AND COMPARATIVE EXAMPLE

To a spun-bonded non-woven fabric of polyethylene terephthalate fibers were tufted 1,600-denier/68-filament bulked nylon 6 pile yarns having a crimp degree of 15.5% and cheese-dyed. All over the back surface of the non-woven fabric was covered with three kinds of polyethylene compounds containing 1%, 2% and 3% by weight of finely divided carbon black having grain diameters in the range of 10 to 250 mμ, respectively. Each of the melted polyethylene compounds was applied on the back surface of the non-woven fabric, in a film form. For comparison, a back surface of the non-woven fabric was similarly treated with polyethylene not containing finely divided carbon black at all (Comparative Example).

With respect to each of the resulting carpet samples, light resistance of the dyed portion and anti-deteriorative property (strength retaining ratio) of the pile yarns were measured.

The results obtained are shown in Table 1.

EXAMPLE 4

Instead of polyethylene used in Example 1, ethylene 70%-vinyl acetate 30% copolymer was employed. In the copolymer were homogeneously dispered 70% by weight of Calcium carbonate filler (CALPET-A supplied by Nitto Funka Kogyo Company) and 0.5% by weight of finely divided carbon black having a grain diameter of 27 mμ.

With respect to the resulting carpet sample, the light resistance of the dyed portion and the anti-deteriorative property (strength retaining ratio) of the pile yarns were measured. The results were also shown in Table 1.

TABLE 1

| | Resinous material | Light resistance After irradiation for 300 hours | Light resistance After irradiation for 400 hours | Strength retaining ratio (%) |
|---|---|---|---|---|
| Comparative Example | Polyethylene not containing carbon black | 1 | 1 | 0 |
| Example 1 | Polyethylene containing 1% by weight of carbon black | 1.5 | 1.5 | 12.5. |
| Example 2 | Polyethylene containing 2% by weight of carbon black | 2.5 | 2 | 57.8 |
| Example 3 | Polyethylene containing 3% by weight of carbon black | 3 | 2.5 | 85.5 |
| Example 4 | Ethylene-vinyl acetate copolymer containing 70% by weight of Calcium carbonate and 0.5% by weight of carbon black | 3.5 | 3.5 | 90.2 |

From these results, it will readily be understood that the carpet of the present invention is improved in the light resistance and the anti-deteriorative properties, compared to the conventional carpet.

According to the dyed carpet of the present invention, only slight fading and discoloration are observed, even if the carpet is exposed to the sun light at elevated temperatures for a prolonged period of time.

Further, according to the carpet of the present invention, the mechanical properties of the pile yarns are scarcely reduced and also the form thereof are scarcely degraded, even when the carpet is subjected to severe tropical weather conditions such as elevated temperatures, rays of the sun and high humidities.

What is claimed is:

1. A carpet having a base fabric, pile yarns tufted to said base fabric and and a backing layer covering a back surface of said base fabric, said backing layer comprising an olefinic polymer, said pile yarns having portions which extend into said backing layer, such portions being substantially covered with resinous material containing from 0.005 percent to 10% by weight of finely divided carbon black, said pile portions being in direct contact with the carbon black-containing resinous material.

2. A carpet set forth in claim 1 wherein said resinous material contains an inorganic filler.

3. A carpet as set forth in claim 2 wherein the inorganic filler is calcium carbonate or aluminum hydroxide.

4. A carpet as set forth in claim 1 or 2 wherein the amount of said filing divided carbon black ranges from 0.0 to 7% by weight.

5. A carpet as set forth in claim 1, wherein said resinous material is employed as said backing layer.

6. A carpet as set forth in claim 5, wherein said resinous material is at least one member selected from the group consisting of polyethylene, polypropylene, stylene-butadiene copolymers, ethylene-vinyl acetate copolymers, polyacrylic esters and polybutadiene.

* * * * *